US006817480B1

(12) United States Patent
Baldasio

(10) Patent No.: US 6,817,480 B1
(45) Date of Patent: Nov. 16, 2004

(54) RECEPTACLE COVERING DEVICE

(76) Inventor: Edna Baldasio, 2950 Hampshire Cir., Corona, CA (US) 92879

( * ) Notice: Subject to any disclaimer, the term of this patent is extended or adjusted under 35 U.S.C. 154(b) by 0 days.

(21) Appl. No.: 10/388,726

(22) Filed: Mar. 17, 2003

(51) Int. Cl.[7] ..... B65D 88/34
(52) U.S. Cl. ..... 220/216; 220/252
(58) Field of Search ..... 220/216, 252, 220/248, 259.1, 259.2, 254.3–254.7, 837, 662, 244; 222/481; 150/154, 165

(56) References Cited

U.S. PATENT DOCUMENTS 2,564,448 A * 8/1951 Ritscher ..... 220/218
3,349,950 A 10/1967 Wanderer
3,421,654 A * 1/1969 Friedrich ..... 220/254.3
3,670,922 A 6/1972 Phillips ..... 220/97
3,782,583 A * 1/1974 Abbey ..... 220/837
4,218,010 A 8/1980 Ruff ..... 229/43
4,393,988 A 7/1983 Burke ..... 229/43
5,301,827 A * 4/1994 Valyi ..... 220/254.3
6,279,788 B1 * 8/2001 Lillelund et al. ..... 222/481
6,672,817 B2 * 1/2004 Denny ..... 426/110

* cited by examiner

*Primary Examiner*—Lien Ngo

(57) ABSTRACT

A receptacle covering devices for use with a food receptacle, namely an ice cream receptacle having a side wall with an inside diameter. The covering device has a planar sheet portion that is sized smaller than the inside diameter of the side wall to fit within the receptacle top opening and span between the receptacle side wall, leaving minimal space between the sheet portion periphery and the receptacle side wall. The sheet portion further has a crease extending across its middle portion for allowing the sheet portion to bend therealong. A handle is mounted on the sheet portion top surface to permit a user to lift one of the sheet portion halves upward, while maintaining the second half in place over the contents of the receptacle.

8 Claims, 4 Drawing Sheets

RECEPTACLE COVERING DEVICE

BACKGROUND OF THE INVENTION

The invention relates to a receptacle covering device. In particular, the invention is a covering device for use in frozen food receptacles, namely ice cream containers. The device forms a temporary seal over the top surface of the contents to reduce freezer burn thereof.

Ice cream is a favorite dessert and treat for many people of all ages. Ice cream is normally sold in half-gallon, pint, or quart sizes. The typical half-gallon container is rectangular shaped, while the typical pint or quart container is round.

Because of the presence of freezers in almost every household, it is possible to keep ice cream in a person's home for consumption. However, once a container of ice cream is purchased, it is usually necessary to consume the dessert within a few days of unsealing and opening the container in which the ice cream is packaged. Once unsealed, the ice cream is subjected to air circulation, thawing and freezing. This results in "freezer burn" of the ice cream which is manifested in the formation of a layer of frost and ice crystals on the top layer of the ice cream, as well as an unpleasant flavor and odor in the food. "Freezer burn" results from periodic thawing and freezing of the item. This is often due to poor air circulation within the freezer, usually the result of an overcrowded freezer.

While "freezer burn" cannot be prevented indefinitely, proper coverage of frozen foods may reduce and delay the unpleasant effects. The standard container covers leave space between the ice cream contained within the container and the cover. This space allows for circulation of air, and eventual "freezer burn" of the ice cream. Further, because of the construction of the container covers, it is common for the cover not to be properly and completely repositioned over the container after use.

Thus, there exists a need for a receptacle closure device that reduces air contact with the food contained therein. Such a device would rest close to top of the food, namely the ice cream, within the receptacle and allow a user to gain access to the contents by lifting part of the covering device. After use, the covering device is returned to a flat position over the ice cream. Such a device would reduce "freezer burn" of the ice cream and enable the ice cream to remain fresh for a longer period of time.

U.S. Pat. No. 4,393,988 to Burke discloses a combination utensil-lid that provides an integral spoon therewith.

U.S. Pat. No. 4,218,010 to Ruff discloses a container lid that is convertible into a spoon. The lid constitutes a water-impermeable sheet that has a flat peripheral ring.

While these units may be suitable for the particular purposes employed, or for general use, they would not be as suitable for the purposes of the present invention as disclosed hereafter.

SUMMARY OF THE INVENTION

In view of the foregoing disadvantages inherent in the prior art, the present invention provides an improved receptacle covering device. As such, the general purpose of the present invention, which will be described subsequently in greater detail, is to provide a new and improved receptacle covering device which has all the advantages of the prior art and none of the disadvantages.

To attain this, the present invention essentially comprises a receptacle covering devices for use with a food receptacle, namely an ice cream receptacle having a side wall with an inside diameter. The covering device has a planar sheet portion that is sized smaller than the inside diameter of the side wall to fit within the receptacle top opening and span between the receptacle side wall, leaving minimal space between the sheet portion periphery and the receptacle side wall. The sheet portion further has a crease extending across its middle portion for allowing the sheet portion to bend therealong. A handle is mounted on the sheet portion top surface to permit a user to lift one of the sheet portion halves upward, while maintaining the second half in place over the contents of the receptacle.

It is an object of the invention to produce a covering device that restricts the air circulation within the receptacle in order to reduce freezer burn of the receptacle contents. Accordingly, the covering device is sized to fit with the receptacle and in use is wedged into place over the receptacle contents. Thus, the amount of circulation around the covering device is reduced.

It is a further object of the invention to produce a covering device that allows a user to obtain access to the receptacle contents without removing said covering device. Accordingly, the covering device has a crease that divides the cover into two half. A handle situated on the top surface of one of the halves enables the user to lift one half while maintaining the second half in place.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

REFERENCE NUMERALS

Figure 1:
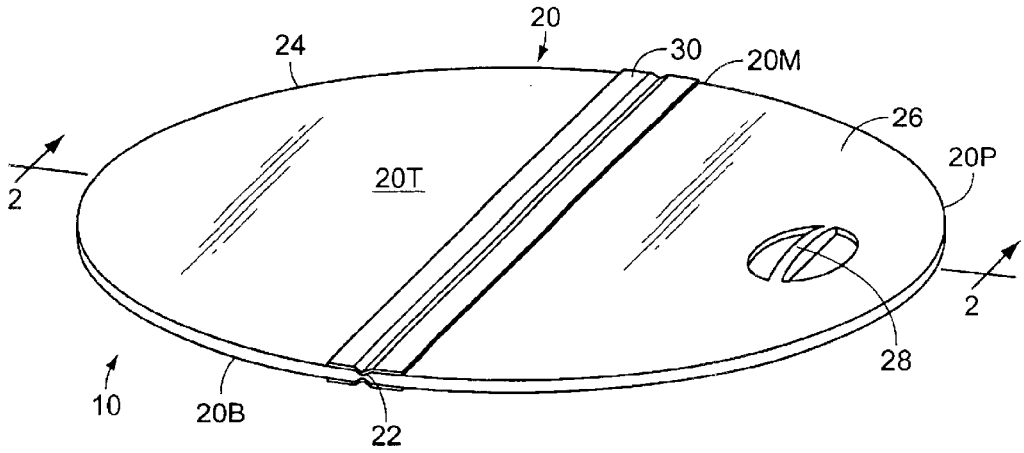
FIG. 1 is a perspective view of the receptacle covering device.

10 receptacle covering device
12 receptacle
13 receptacle contents
14 receptacle container portion
16 receptacle top opening
18 receptacle side wall
18A receptacle side wall inside
19 existing receptacle lid
20 covering device sheet portion
20T sheet portion top surface
20B sheet portion bottom surface

20P sheet portion periphery
20M sheet portion middle portion
22 crease
24 stationary half
26 movable half
28 handle
29 circular recess

DETAILED DESCRIPTION OF THE PREFERRED EMBODIMENTS

FIG. 1 illustrates a receptacle covering device 10 for use with a food receptacle 12, namely an ice cream receptacle. For illustrative purposes only, the receptacle covering device 10 is shown in the drawings as being circular shaped. This covering device 10 would typically be utilized with pint and quart sizes receptacles that are usually round in shape. It should be noted that a variety of sizes and shapes may be employed according to the size and shape of the receptacle 12A in which the covering device 10 is to be used. By way of example, FIG. 6 illustrates the covering device 10 having a rectangular shape for use with half-gallon receptacles.

Figure 4:
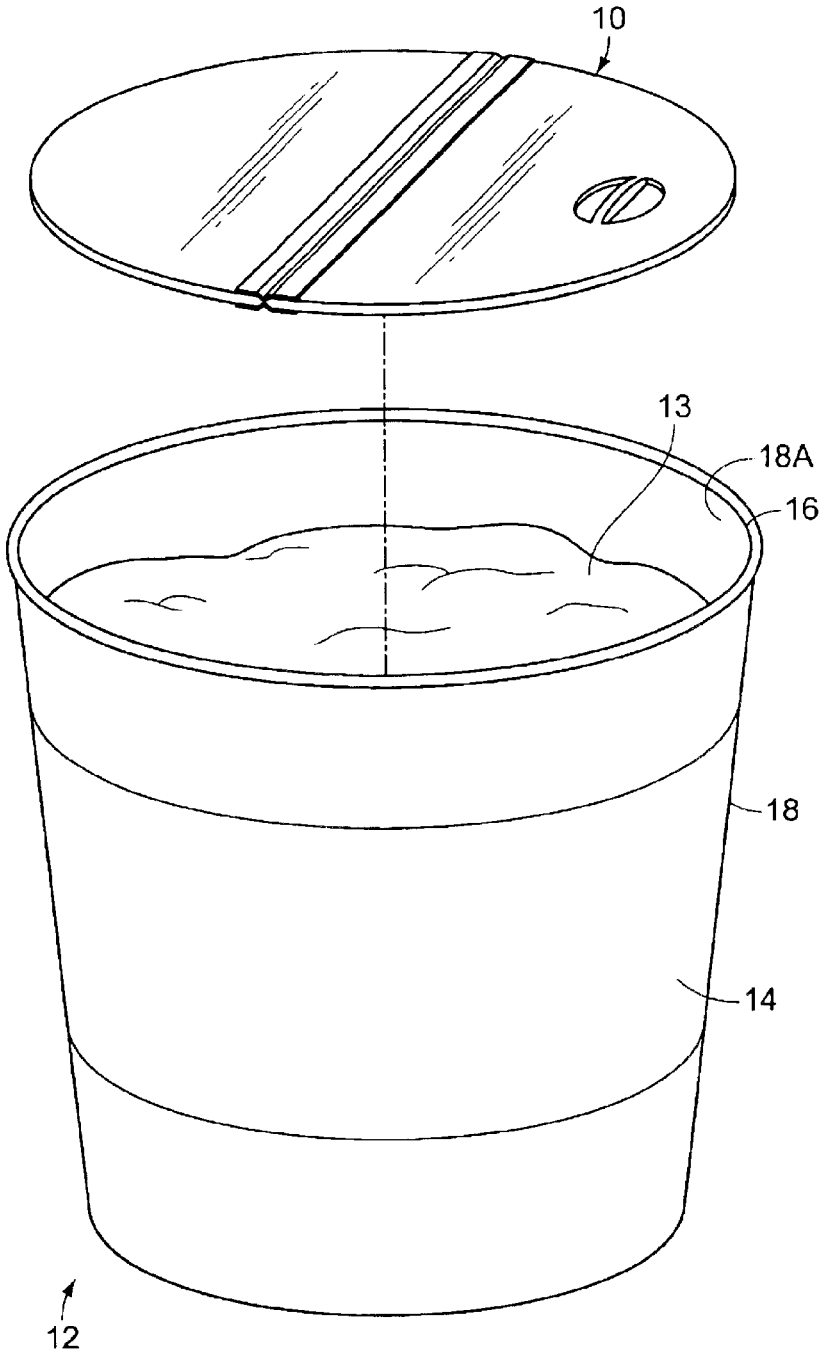
FIG. 4 is a perspective view of the covering device being inserted into a receptacle through the receptacle top opening.
Figure 5:
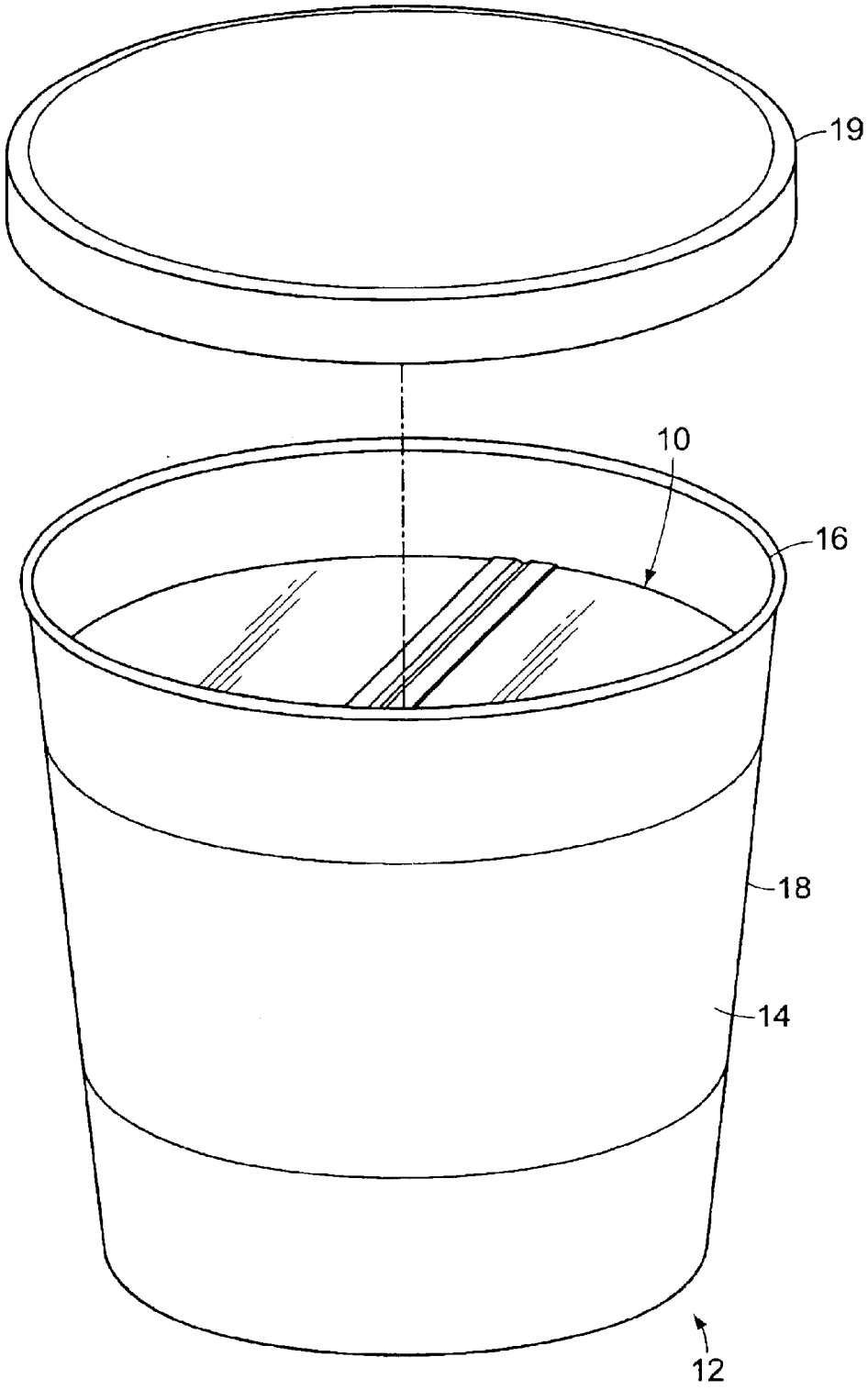
FIG. 5 is a perspective view of the covering device in place within the receptacle, illustrating securement of the receptacle lid thereover.
Figure 6:
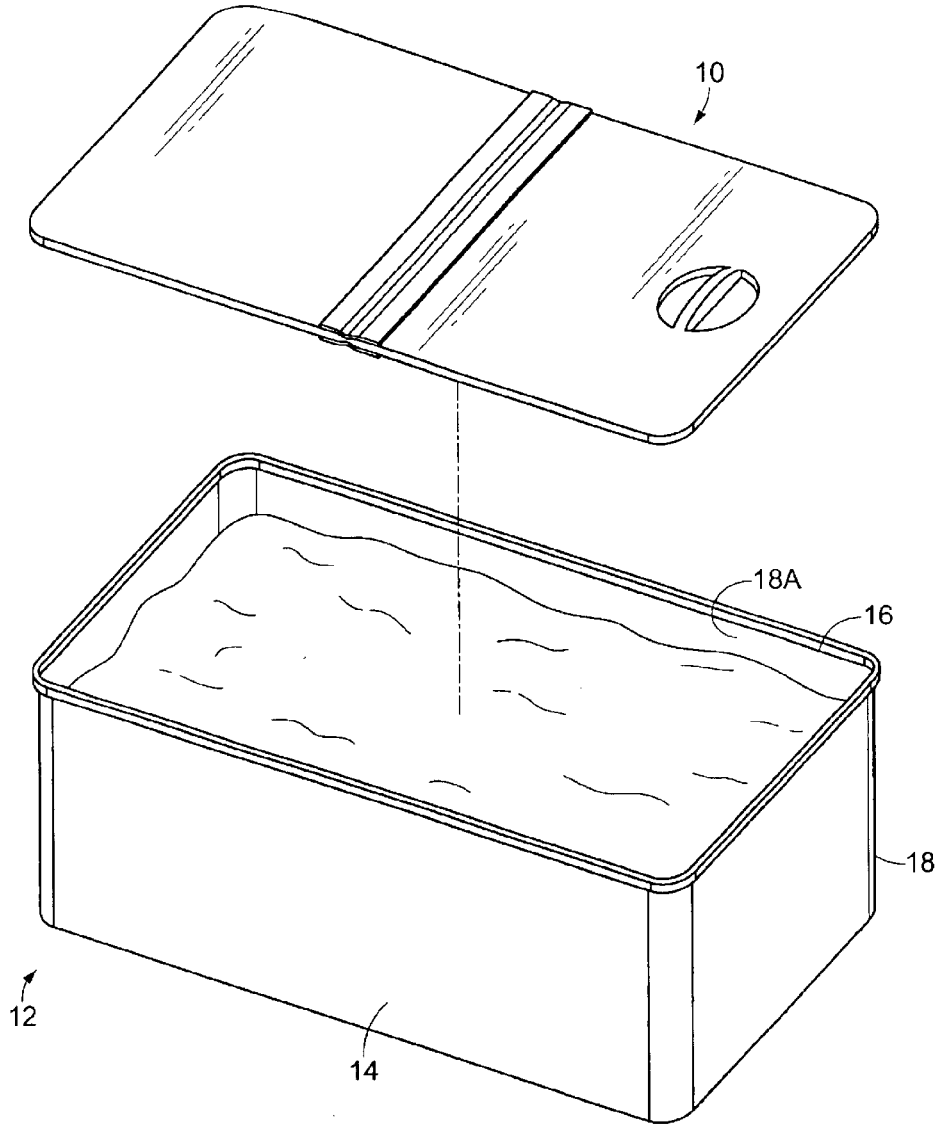
FIG. 6 is a perspective view of an alternate embodiment of the receptacle covering device for use with a rectangular receptacle.

Referring to FIGS. 4, 5, and 6, the receptacle 12 with which the covering device 10 is used essentially comprises a container portion 14, a top opening 16, and a side wall 18 extending downward from and around the periphery of the container portion 14. The side wall 18 has a side wall inside 18A. The container portion 14 houses food contents, particularly ice cream. The receptacle 12 further comprises a lid 19, as illustrated in FIG. 5. The lid 19 extends over and covers the receptacle top opening 16.

Figure 2:
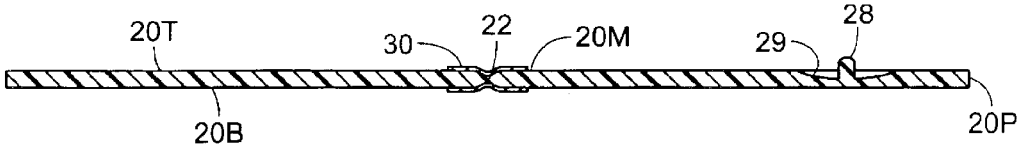
FIG. 2 is a cross sectional view of the receptacle covering device taken along line 2 in FIG. 1.
Figure 3:
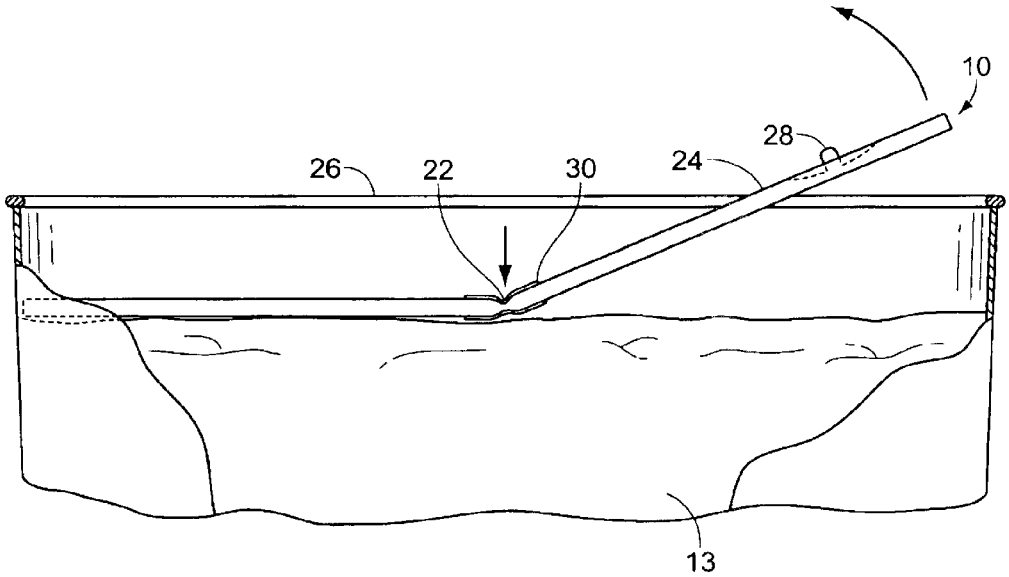
FIG. 3 is a front elevational view of the receptacle covering device in place within a receptacle, illustrating the lifting of the movable half of the covering device.

Referring back to FIG. 1 and to FIG. 2, the receptacle covering device 10 comprises a planar sheet portion 20 having a top surface 20T, a bottom surface 20B, a periphery 20P, and a middle portion 20M extending through the center of said covering device 10. The sheet portion 20 is sized to fit within the receptacle top opening 16 and extend within the receptacle side wall inside 18A, leaving minimal space between the sheet portion periphery 20P and the receptacle side wall 18. The sheet portion 20 further has a crease 22 extending across the middle portion 20M thereof. The crease 22 is a scoring that extends upward from the sheet portion bottom surface 20B and downward from the sheet portion top portion 20T, said crease 22 allowing the sheet portion 20 to bend therealong. The crease 22 divides the sheet portion 20 into two halves, namely a stationary half 24 and a movable half 26. Accordingly, the crease 22 is a "weakening" of the sheet portion 20, although the halves 24, 26 remain connected at said crease 22. The movable half 26 has a handle 28 mounted thereon along the sheet top surface 20T. The handle 28 allows a user to lift the movable half 26 upward, while maintaining the stationary half 24 in place over the contents 13 of the receptacle 12, as illustrated in FIG. 3. To facilitate use of the handle 28, a circular recess 29 substantially surrounds the handle 28 to allow the handle 28 to be easily gripped. Moreover, raising the movable half 26 permits access to the receptacle contents 13.

One or two reinforcement strips 30 are also provided, each of said strips 30 extending longitudinally over the crease 22. One reinforced-strip 30 extends along the sheet portion top surface 20T. Additionally, a second reinforcement strip 30 may be applied over the bottom surface 20T of the sheet portion 20 at the crease 20 to further reinforce the covering device 10. The reinforcement strip 30 is adhered to the sheet portion 20 on both sides of the crease 22 and provides additional strength to the sheet portion 20 along the crease 22, thereby reducing the possibility of the sheet portion 20 snapping along the crease 22 due to repeated bending.

While the covering device 10 may be constructed from a variety of materials, it is preferably constructed from a plastic transparent material. The plastic material must have a degree of flexible to allow bending along the crease 22 while maintaining a degree of rigidity to wedge within the receptacle 12 and perhaps expand the receptacle 12 slightly, especially in the case of receptacles 12 which are slightly tapered in the downward direction. Further, the transparency of the covering device 10 enables the user to view the receptacle contents 13 without removing said covering device 10.

In use, the user selects the proper receptacle covering device 10 according to the size and shape of the receptacle 12 with which the covering device 10 is to be used. By way of example, the circular covering device 10 would be utilized with a round receptacle 12, namely a pint or quart sized receptacle, and the rectangular covering device 10R would be utilized with a rectangular receptacle 12, namely a half gallon sized receptacle. The covering device 10 is then placed into the receptacle 12, through the receptacle top opening 16, and is wedged into place against the receptacle side wall inside 18A, with the covering device bottom surface 20B adjacent to the receptacle contents. The covering device top surface 20T is oriented upward towards the receptacle top opening 16. The covering device 10 is preferably placed as close to the top surface of the receptacle contents 13 as possible to reduce the amount of air circulation thereunder. Once in place, the user may obtain access to the receptacle contents 13 by lifting upward the movable half 26 by way of the handle 28. After use, the movable half 26 is lowered back into place and the receptacle lid 19 is placed over the receptacle top opening 16. The receptacle 12 then may be stored in the freezer for future use.

In conclusion, herein is presented a receptacle covering device for reducing freezer burn of the receptacle contents during storage in a freezer. The invention is illustrated by example in the drawing figures, and throughout the written description. It should be understood that numerous variations are possible, while adhering to the inventive concept. Such variations are contemplated as being a part of the present invention.

What is claimed is:

1. A receptacle covering device for use with a food receptacle having food contents contained therein, the food receptacle having a container portion, a top opening, and a side wall extending downward from the top opening, the side wall having a side wall inside, comprising:

a single-planar sheet portion, the sheet portion having a top surface, a bottom surface, a periphery, and a middle portion dividing the sheet portion into two halves, wherein the sheet portion is sized to be fit within the receptacle top opening down against the food contents therein and extend substantially fully between the receptacle side wall inside, the sheet portion also having a crease extending across the middle portion for allowing the sheet portion to bend to raise one of the two halves for permitting access to the receptacle contents without having to remove the other half of the sheet portion from the food contents, and wherein the sheet portion further comprises a reinforcement strip, the strip extending longitudinally over the crease and adhered to both halves for providing added strength at said crease.

2. The receptacle covering device as recited in claim 1, wherein the two halves created by the crease comprise a stationary half and a movable half, the movable half having a handle mounted on the sheet portion top surface, said handle allowing the user to lift the movable half upward while the stationary half remains flat against the food contents.

3. The receptacle covering device as recited in claim 2, wherein the crease extends downward from the sheet portion top surface.

4. The receptacle covering device as recited in claim 3, wherein the crease further extends upward from the sheet portion bottom surface.

5. The receptacle covering device as recited in claim 4, wherein the covering device is in the shape of a rectangle.

6. The receptacle covering device as recited in claim 4, wherein the covering device is in the shape of a circle.

7. The receptacle covering device as recited in claim 4, wherein the covering device constructed from a transparent plastic material.

8. The receptacle covering device as recited in claim 4, wherein the covering device constructed from a transparent plastic material.

* * * * *